US006254308B1

(12) United States Patent
Cognon

(10) Patent No.: US 6,254,308 B1
(45) Date of Patent: Jul. 3, 2001

(54) EQUIPMENT AND A METHOD FOR PARTIALLY DRYING A ZONE OF GROUND CONTAINING A LIQUID

(75) Inventor: Jean-Marie Cognon, Sceaux (FR)

(73) Assignee: Menard Soltraitement (FR)

( * ) Notice: Subject to any disclaimer, the term of this patent is extended or adjusted under 35 U.S.C. 154(b) by 0 days.

(21) Appl. No.: 09/257,019

(22) Filed: Feb. 25, 1999

(51) Int. Cl.[7] ..... F02B 11/00
(52) U.S. Cl. ..... 405/43; 405/36
(58) Field of Search ..... 405/36, 43, 45, 405/56, 53, 128, 130, 131

(56) References Cited

U.S. PATENT DOCUMENTS

| | | | | |
|---|---|---|---|---|
| 4,020,902 | * | 5/1977 | Valdespino | 405/43 |
| 4,293,237 | * | 10/1981 | Robey et al. | 405/43 |
| 4,704,047 | * | 11/1987 | Oldfelt et al. | 405/43 |
| 4,752,402 | * | 6/1988 | Gray | 405/43 |
| 4,878,781 | * | 11/1989 | Gregory et al. | 405/43 |
| 5,228,804 | * | 7/1993 | Balch | 405/131 |
| 5,558,463 | * | 9/1996 | Geisel | 405/128 |

FOREIGN PATENT DOCUMENTS 0329500 1/1989 (EP) .
2663373 6/1990 (FR) .

* cited by examiner

*Primary Examiner*—Eileen D. Lillis
*Assistant Examiner*—Frederick L. Lagman
(74) *Attorney, Agent, or Firm*—Rothwell, Figg, Erns & Manbeck, p.c.

(57) ABSTRACT

Equipment for at least partially drying a zone of ground containing a liquid, the equipment comprising: a substantially air-tight membrane, covering the zone of ground to be dried, an embankment permeous to water and disposed under the membrane, first drain tubes disposed vertically in the zone of ground and in fluid communication with the permeable embankment, second drain tubes connected to a suction pump and laid substantially flat in the embankment. The second drain tubes are in fluid communication with the liquid collected in the first drain tubes, under the membrane, and comprise a series of fluid input holes opened within the embankment for communicating with the fluid contained in said embankment, in order to evacuate the liquid collected from the ground and obtain an air depression under the membrane. Possibly, the equipment is also provided with third drain tubes extending substantially horizontally in the embankment, under the membrane, and comprising a series of fluid input holes for an input of fluid therein, the third drain tubes being disposed at a level above the level of the second drain tubes, in a zone of the embankment which is unsaturated with liquid, and being connected to an air suction means.

12 Claims, 3 Drawing Sheets

EQUIPMENT AND A METHOD FOR PARTIALLY DRYING A ZONE OF GROUND CONTAINING A LIQUID

The invention relates to an assembly for partially drying a zone of a substantially non permeable (or weakly permeous) ground containing a liquid. The invention is also directed to a method for drying such a zone.

BACKGROUND OF THE INVENTION

An equipment for drying a zone of ground weakly permeous to liquid, (especially water), is already known.

Such an equipment comprises:

- a substantially air-tight membrane, covering the zone of ground to be dried and comprising a peripheral sealing means for allowing a partial vacuum to be obtained under the membrane,
- an embankment permeous to water and disposed under the membrane, over the zone of ground to be dried,
- first drain tubes disposed substantially vertically in the zone of ground and in fluid communication with the permeable embankment,
- second drain tubes connected to a suction pump, those second drain tubes being laid substantially flat in the embankment and in fluid communication with the liquid collected in the first drain tubes, under the membrane.

Such an assembly including an air depressed membrane is already known, especially for reinforcing weak grounds impregnated with water and having a low permeability to water.

Such grounds are improper to receive buildings thereon.

For reinforcing such grounds and improving their mechanical strength, a partial vacuum is created under the membrane.

The permeable material of the embankment is typically sand. The sand is disposed on the zone of ground to be reinforced (i.e. a layer of weak clay).

SUMMARY OF THE INVENTION

An object of the invention is to propose a solution in connection with the following problems, (it is to be noted that in the following description, the liquid to be expelled from the ground is water, even if various other liquids could be concerned).

The problems to be solved include what follows:

- effectiveness of the fluid suction, whatever the fluid may be (water, air . . . ),
- speed of the ground compacting effect,
- optimizing the arrangement of the various tubes, drain tubes, suction means, for improving the yield,
- optimizing the height of the embankment for combining an efficient depression of air under the membrane and a height of embankment less than a critical height possibly involving a mechanical shearing of the embankment.

So, according to the invention, the second drain tubes comprise a series of fluid input holes opened within the embankment for communicating with the fluid contained in said embankment, in order to evacuate the liquid collected from the ground and obtain the required depression under the membrane.

Thus, the suction of air will be obtained from a larger area than in the prior art, within the embankment, the liquid to be expelled (and air to be exhausted) being taken from the embankment which will be partly filled with water (especially in its lower portion).

According to two other features of the invention:

- the second drain tubes comprise a series of drain tubes, and the distance between two such successive drain tubes of the series is about 5 to 25 times larger than the vertical distance (height) between the level of the series of second drain tubes and a maximum level of the liquid within the embankment,
- and the first drain tubes are separated from the second drain tubes, the liquid collected in the first drain tubes passing in the embankment before entering into the second drain tubes.

Thus, the distribution of the drain tubes will be optimized as in the ground as in the embankment, while improving the yield and thus, the speed of the ground compacting effect.

According to a preferred complementary feature of the invention:

- the equipment further comprises complementary air suction tubes, for expelling air contained within the embankment and creating therein the air depression (in addition to, or instead of, the second drain tubes, the later being then only reserved for sucking up the water),
- under the membrane, at least some of those air suction tubes are connected to third drain tubes which are laid flat in the embankment and which comprise a series of fluid input holes for an input of fluid therein,
- the third drain tubes are disposed at a level above the level of the second drain tubes, in a zone of the embankment which is unsaturated with liquid, and those third drain tubes are connected to an air suction means.

For further improving the yield of the equipment, an other advice is as follows:

- one of the third drain tubes is advantageously disposed substantially straight above one of the second drain tubes,
- and at least locally in the embankment, the third drain tubes are disposed every other time over the second drain tubes.

In connection with the method for drying a ground, as taught by the invention, it is recommended to proceed as follows:

- disposing the first drain tubes in the zone of ground to be dried, for collecting at least the portion of the liquid to be expelled for drying the zone,
- disposing the second drain tubes in fluid communication with the liquid collected through the first drain tubes, while laying said second drain tubes flat over said zone of ground, within a draining embankment erected over the zone of ground to be dried and in fluid communication with the first drain tubes,
- covering the embankment (and thus the zone of ground to be dried) with an air-tight membrane,
- passing the second drain tubes through the membrane, while obtaining a sealing of said membrane, in such a way that a depression of air can be created thereunder, and
- sucking gaseous and liquid fluids contained in the embankment, through fluid input holes provided in the second drain tubes, for creating said depression under the membrane while expelling the liquid from the ground.

If the embankment is provided with the abovementioned third drain tubes, it will be possible to substantially dissociate the suction of water (essentially through the second drain tubes) from the suction of air (essentially through the third drain tubes).

Further, the invention is as disclosed in the appended claims.

DETAILED DESCRIPTION OF THE INVENTION

Figure 1:
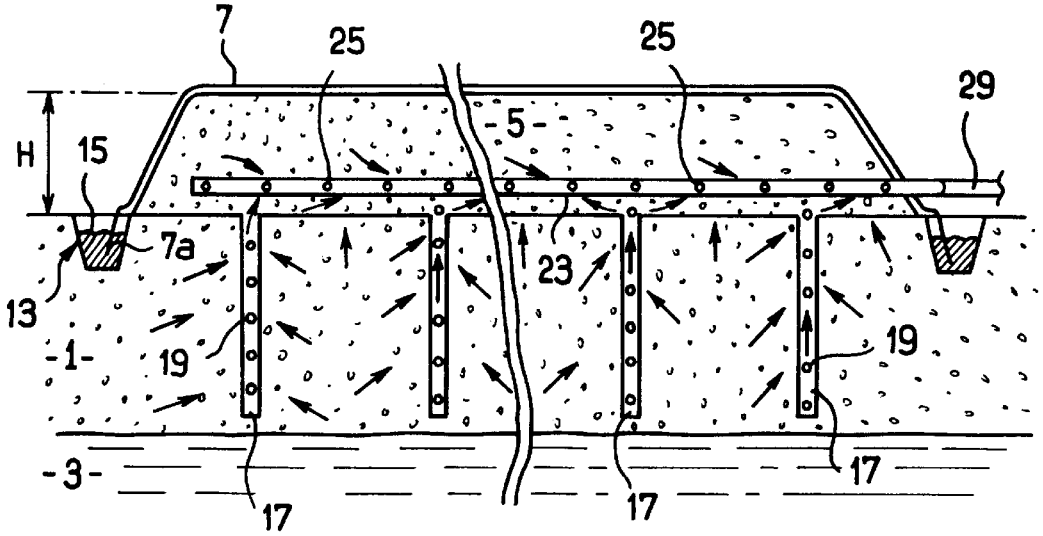
FIG. 1 is a diagrammatic longitudinal section of a portion of the equipment located essentially over the zone of ground to be dried (line I—I of FIG. 3)

In FIG. 1, reference 1 is the zone of ground to be reinforced, such as a layer of weak clay extending over a ground layer 3 permeous to the liquids. (A ground is considered as mechanically <<weak>> if its module of elasticity (E) is less than about 80 bars).

The ground 1 is a compressible ground typically located just near a river and in which the water is at the ground level or just below (one or a few meters deep). The ground 1 has a low permeability to water.

Above the zone of ground 1 is erected an embankment 5 made from a material permeous to the liquid to be exhausted, and thus permeous to air. The embankment is a draining layer for water.

Advantageously, the embankment is made of sand or of granular material compatible with the permeability to the fluids to be exhausted (air+water).

The layer 5 is overlaid with a membrane 7 which is (substantially) non permeable to liquid and air-tight. The surface covered by the embankment and the membrane 7 determines the surface of ground to be reinforced, the limits of which are the peripheral limits (or border) of the membrane and of the embankment disposed thereunder.

Figure 4:
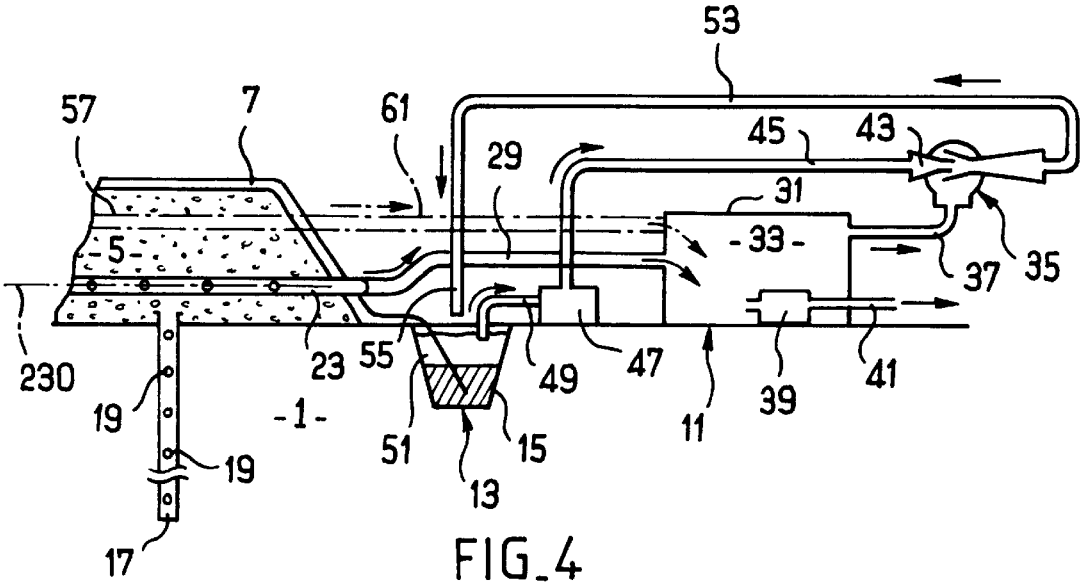
FIG. 4 is a complement of FIG. 1 which shows more specifically the fluid suction system (liquid to be expelled and air to be exhausted)

The full depth (or height) <<H>> of the body 5 can be of about 20 cm to 60 cm and, in such a body, a partial air vacuum of about 60 KPa to 80 KPa can be obtained by using for example a pump referenced 11 in FIG. 4.

The membrane 7 is advantageously a strong membrane made of rubber.

For obtaining the peripheral sealing of the membrane and thus creating the air depression thereunder, a trench 13 opened to the air is digged in the ground, along the perimeter of the ground zone 1. Then the trench is filled with a sealing material 15, such as a bentonitic mud. All the peripheral border 7*a* of the membrane 7 is then immersed into the sealing material 15.

For accelerating the compacting effect, vertical hole drain tubes 17 have been previously disposed in the weakly permeable layer 1.

Figure 2:
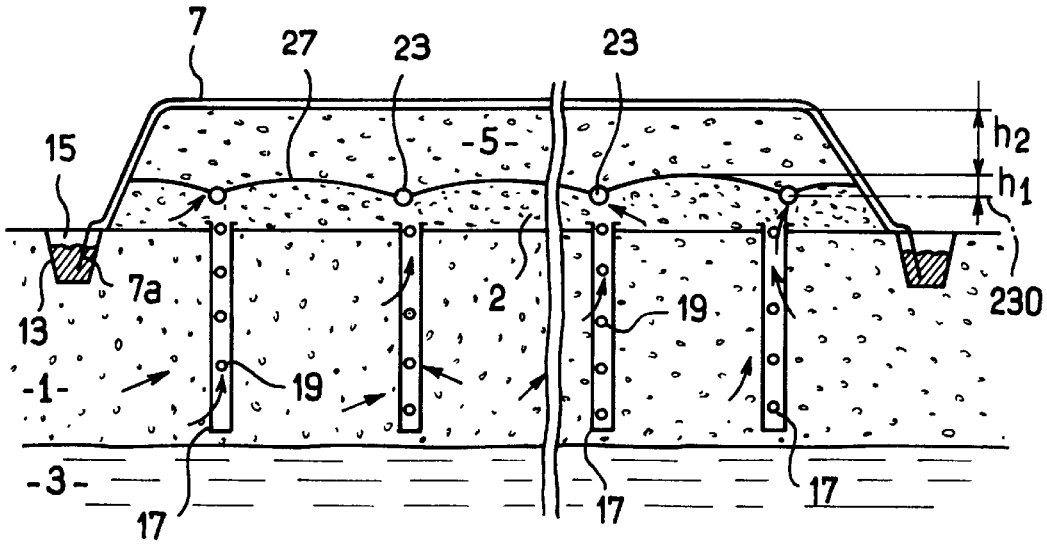
FIG. 2 is a diagrammatic transversal section, along the line II—II of FIG. 3.

For example, the substantially vertical drain tubes 17 are separated therebetween from about 2 meters to 6 meters along two perpendicular directions, as it can be seen in FIGS. 1 and 2.

A borer or a drill can be used to do so.

The drain tubes can be porous tubes having strainers, or perforated tubes made of plastic material and having an inner diameter for example of about 50 mm, adapted to allow the liquid to be expelled from the ground 1 to enter therein through the fluid input holes 19.

The drain tubes 17 stop just above the underlying layer 3, especially if the layer 3 is a draining layer.

At the surface level, the vertical drain tubes 17 are opened for being in fluid communication with the granular body 5 (even if a protection prevents the material of the embankment from falling within the drain tubes).

All the more because of the air depression created in the layer 5, the water contained in the layer 1 rises up to the body 5. In the ground, the water is naturally accumulated in the drains 17 which are progressively filled with the liquid to be expelled.

In the granular embankment 5 are further layed horizontal second drain tubes 23 disposed at a higher level than the upper end of the drain tubes 17. Thus, drain tubes 17 and 23 are separated one from the other and are not connected therebetween.

Drain tubes 23 can be perforated tubes having the same diameter than the first drain tubes (for example 50 mm). They comprise fluid input holes 25.

Those holes 25 are staggered along at least the major length of the drain tubes under the membrane and are disposed on the periphery thereof. The diameter of the holes 25 is adapted to enter and exhaust the water (and possibly air) contained in the embankment 5 through said drain tubes 23 (if the zone of the granular body in which said second drain tubes extend is not fully impregnated (saturated) with water).

The second drain tubes 23 extend below the level 27 of the water risen within the embankment 5 (a stabilized situation of the equipment is supposed).

So, the drain tubes are (at least) partially immersed within the water to be expelled. The water level line 27 shows substantially the shape of the <<climbing down curves>> of said water in the embankment, due to the suction created by the pump assembly 11 which is connected to the drain tubes 23.

Figure 3:
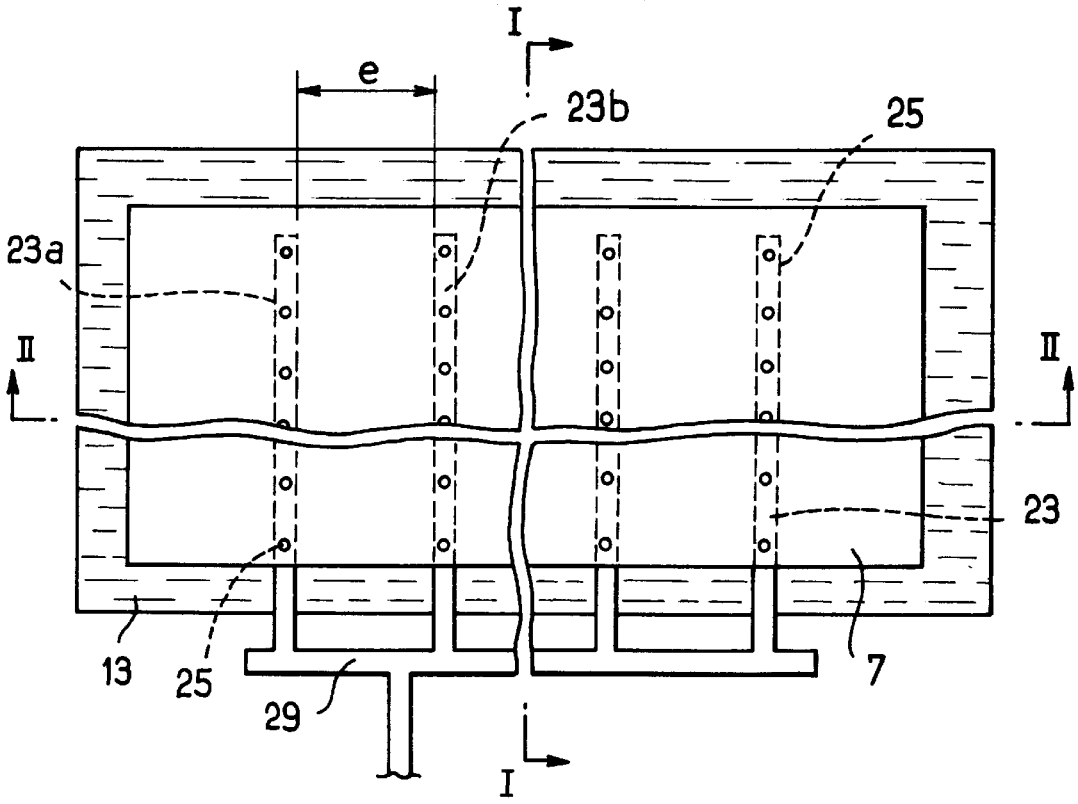
FIG. 3 shows a diagrammatic view from over the assembly, at a reduced scale.

According to the invention, the distribution of the second drain tubes 23 is optimized:

Firstly, those drain tubes consist of a series of drain tubes disposed parallel one to the other, in a substantially horizontal plane, as it can be seen in FIGS. 1, 2 and 3.

Further, the distance <<e>> between two successive drain tubes (such as referenced 23*a* and 23*b* in FIG. 3) is such as said distance is between five times and twenty-five times the vertical distance <<$h_1$>> (see FIG. 2) between the mid-level (referenced 230) of the series of the second drain tubes 23 and the maximal liquid level in the embankment (top of the curve 27, between two successive drain tubes of the series).

Preferably, the distance <<e>> will even be comprised five times and fifteen times the height <<$h_1$>>.

So, a layer having a height <<$h_2$>> of <<dried>> material 5 (or at least non saturated with water) will further be maintained between the maximal water rising level and the membrane 7.

For optimizing the air depression, the height <<$h_2$>> will preferably be equal to at least 10 cm (for example comprised between substantially 10 cm and 30 cm).

According to a best mode, the perforated drain tubes 23 will have a diameter of about 5 cm.

The following conditions are further supposed:

permeability of the layer 5 of about $10^{-3}$ m/s;

suction pump means 11 (connected to all the drain tubes 23) having a water delivery of about 100 $m^3$/h. Such a pump is supposed to be used for a surface of ground of about 3 000 $m^2$;

the horizontal distance <<e>> between two successive drain tubes 23 is of about 2.5 m;

the delivery by linear meter of drain tube is, in such a situation, considered as equal to substantially 20 to $25\times10^{-6}$ $m^3$/m/s.

In such conditions, <<$h_1$>> is comprised between substantially 10 cm and 20 cm (it is supposed that the two drain tubes selected for the example, such as 23*a* and 23*b*, are substantially identically operated).

Thus, the drain tubes 23 will suck up liquid from the embankment 5 and will be further used for creating the air depression within said granular body 5, above the liquid level.

Through their input holes 25, the drain tubes 23 will then typically aspirate a mixture of air and water coming from the body 5. Such a mixture will be separated in the pump means 11.

As it can be seen in FIGS. 1 to 3, the horizontal perforated drain tubes 23 pass air-tightly through the membrane 7 and are connected to one (or a plurality) of collector(s) such as referenced in 29. The collector(s) is connected to the pump equipment 11.

As disclosed in FR-B-2 663 373 (page 5, line 32 to page 8, line 31), the pump means 11 can especially comprise an air-tight box 31 comprising an input 31*a* which is connected to the collector(s) 29 in which circulate not only water, but also air.

For separating air from water, the box 31 includes a separation chamber 33.

Air accumulated in the higher portion of the chamber is sucked to the air pump 35 in a duct 37 provided with a one-way valve.

Near the bottom of the chamber 33, a water pump 39 expells the water contained in the ground and/or in the embankment 5. The water is directed to the expelling duct 41.

The sealed box 31 is closed, air-tight and adapted to resist to the air depression induced by the pump 35.

The pump for water 39 is adapted for being intermittently operated.

The pump for air 35 can be a pump called <<liquid ejector FLUXERO®<<.

For operating such a pump, a high speed jet of liquid is propelled.

An admission duct 45 supplies the pump 35 with water, in 43.

The admission duct 45 is connected to a water pump 47, the input of which is connected by a duct 49 to a water tank 51.

The water tank can consist of the top part of the trench 13 in which the volume of water 51 <<floats>> over the mud 15.

The output of the air vacuum pump 35 is connected to an expelling duct (water/air) 53 which opens in 55 above the water tank 51.

In FIG. 4, the drain tubes means 17, 23 also comprise third drain tubes 57 disposed in the embankment 5 at a level higher than the mid-level 230 of the second drain tubes 23.

Figure 5:
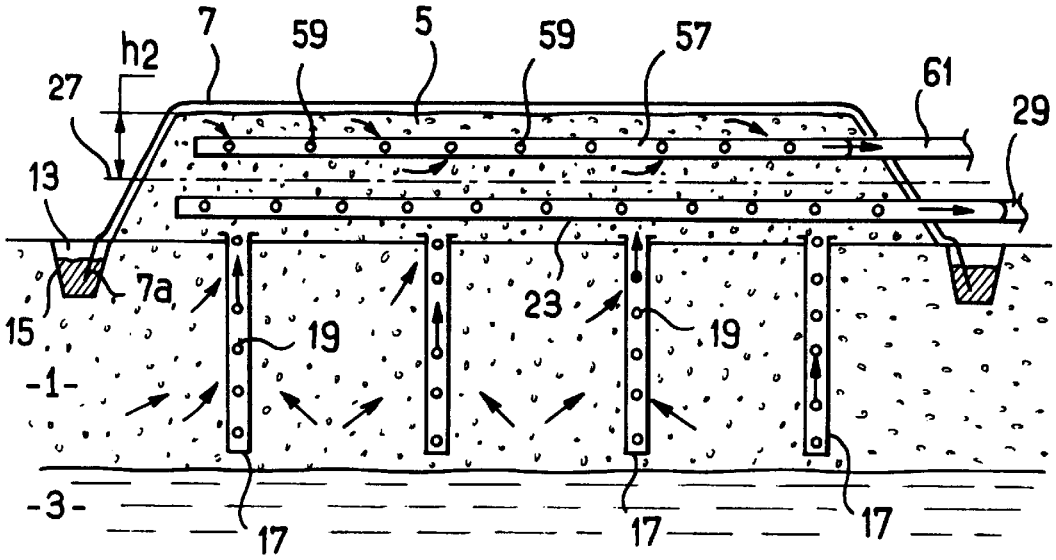
FIGS. 5 and 6 show again the illustrations of FIGS. 1 and 2, while showing the <<third drain tubes>>, more especially reserved for sucking air from under the membrane.
Figure 6:
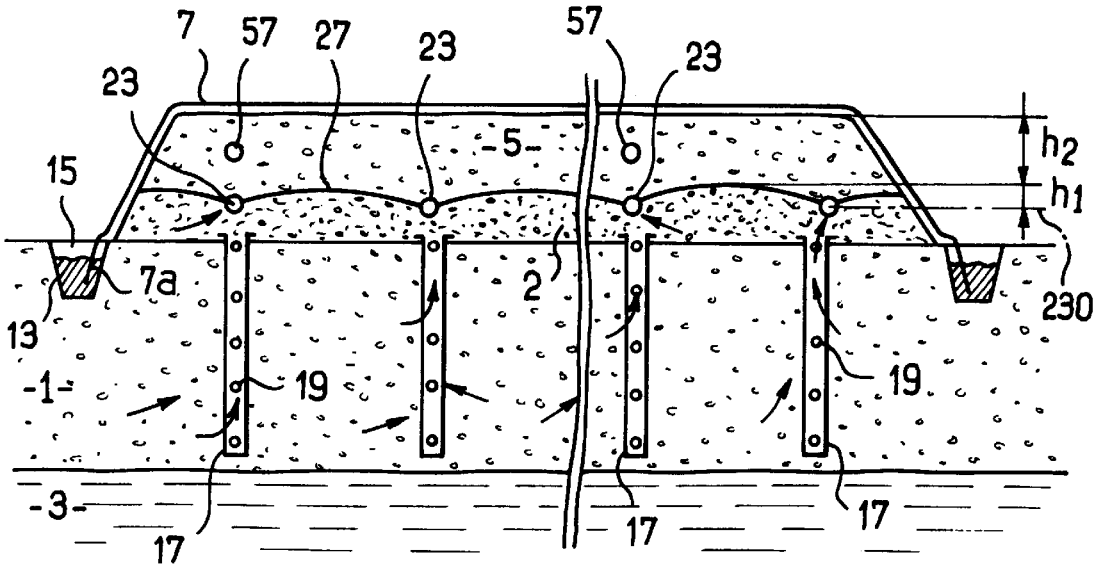

The third drain tubes 57 are perforated along at least the major portion of their length and extend in the embankments wherein they are substantially horizontally disposed (see FIGS. 5 and 6).

The drain tubes 57 comprise fluid input holes 59 adapted for entering (at least) air therein.

Preferably, the drain tubes 57 are disposed in the upper portion of the granular embankment, above the maximal level 27 of the liquid to be expelled, viz. in the portion <<$h_2$>> of the body 5.

In the immediate vicinity of the lateral edge of the embankment 5, the drain tubes 57 are connected to tubes 61 already used in the prior art for expelling air (previously, those tubes were only engaged on a short distance through the membrane, into the embankment, and took off air by their opened free end, only).

The tubes 61 are connected to the pump 11, at the upper part thereof, above the level of liquid present therein. Thus, air accumulated at the top of chamber 33 can be exhausted through the duct 37 to the pump 35 (the phantom lines in FIG. 4 show such an exhaustion).

Further, the second drain tubes 23 can be disposed a little bit lower in the embankment 5. Thus, those drain tubes will be substantially immersed in the water risen up from the ground 1.

In such a situation, the drain tubes 23 will substantially only contain water to be expelled by the pump, whereas the upper drain tubes 57 will substantially only contain air to be exhausted. If the disposition of FIGS. 1 and 2 is reproduced for the drain tubes 23, a mixture of air and water will be expelled therethrough.

In FIG. 6, it is to be noted that the third drain tubes 57 are disposed parallel to the second drain tubes, with a determined drain tube 57 just above a determined drain tube 23.

Such a disposition induces a reduction of the embankment height and also a reduction of height between the second and the third drain tubes.

It is even advantageously suggested to dispose a determined third drain tube every other second drain tube, as shown in FIG. 6, since the drain tubes 57 are more particularly reserved to exhaust the air from under the membrane, what improves the yield of such an exhaustion.

It is also to be noted that the invention as presently disclosed provides the following improvements:

it is no more useful to dig wells into the ground to be dried for disposing therein, firstly, a porous tube within which was, secondly, engaged a water expelling duct (drain tube), it is useless to dispose a pump at the bottom of such wells, for drawing off water therefrom, it is useless to connect the abovementioned water expelling tubes to the horizontal drain tubes disposed within the embankment, it is now possible to improve the exhaust of air from the embankment (see for those items FR-B-2 663 373 and FR-B-2 627 202, especially).

In relation to the embankment, it is also to be noted that limiting the height thereof, while improving the yield of exhausting water and/or air, reduces the shearing stresses and thus a possible sliding of the embankment.

Further, in relation to the first and second drain tubes (17, 23), even if the advice is not to connect those tubes therebetween, it could done while maintaining complementary holes through the wall of the second drain tubes, for directly taking off the fluid in the embankment (abovementioned holes 25).

What is claimed is:

1. An equipment for at least partially drying a zone of ground containing a liquid, the equipment comprising:

a substantially air-tight membrane, covering the zone of ground to be dried and comprising a peripheral sealing means for allowing an air depression to be obtained under the membrane, an embankment permeous to water and disposed under the membrane, over the zone of ground to be dried, first drain tubes disposed substantially vertically in the zone of ground and in fluid communication with the permeable embankment, second drain tubes connected to a suction pump, those second drain tubes being laid substantially flat in the embankment and in fluid communication with the liquid collected in the first drain tubes, under the membrane, wherein the second drain tubes comprise a series of fluid input holes opened within the embankment for communicating with the fluid contained in said embankment, in order to evacuate the liquid collected from the ground and obtain the required depression under the membrane.

2. The equipment of claim 1, wherein the second drain tubes comprise a series of drain tubes, and the distance between two such successive drain tubes of the series is about 5 to 25 times larger than the vertical distance between the level of the series of second drain tubes and a maximum level of the liquid within the embankment.

3. The equipment of claim 1, wherein the first drain tubes are separated from the second drain tubes, the liquid collected in the first drain tubes passing in the embankment before entering into the second drain tubes.

4. The equipment of claim 1, further comprising:

third drain tubes extending substantially horizontally in the embankment, under the membrane, and comprising a series of fluid input holes for an input of fluid therein, the third drain tubes being disposed at a level above the level of the second drain tubes, in a zone of the embankment which is unsaturated with liquid, and being connected to an air suction means.

5. The equipment of claim 4 wherein one of the third drain tubes is disposed substantially straight above one of the second drain tubes.

6. The equipment of claim 4, wherein, at least locally in the embankment, the third drain tubes are disposed every other time over the second drain tubes.

7. An equipment for at least partially drying a zone of ground containing a liquid, the equipment comprising:

a substantially air-tight membrane, covering the zone of ground to be dried and comprising a peripheral sealing means for allowing an air depression to be obtained under the membrane, an embankment permeous to water and disposed under the membrane, over the zone of ground to be dried, first drain tubes disposed substantially vertically in the zone of ground and in fluid communication with the permeable embankment, second drain tubes connected to a suction pump, those second drain tubes being laid substantially flat in the embankment and in fluid communication with the liquid collected in the first drain tubes, under the membrane, ducts connected to air suction means for exhausting air contained under the membrane, wherein at least some of said ducts are connected, under the membrane, to third drain tubes which are substantially horizontally disposed in the embankment, at a level above the level of the second drain tubes, and wherein the second and third drain tubes comprise a series of fluid input holes opened within the embankment for entering therein fluid contained in said embankment.

8. The equipment of claim 7, wherein:

the second drain tubes are disposed in a low zone of the embankment containing liquid to be evacuated, and the third drain tubes are disposed in a high zone of the embankment which is unsaturated with liquid.

9. The equipment of claim 7, wherein one of the third drain tubes is disposed substantially straight above one of the second drain tubes.

10. The equipment of claim 7, wherein at least locally in the embankment, the third drain tubes are disposed every other time over the second drain tubes.

11. A method for at least partially driving a zone of ground containing a liquid, the method comprising the steps of:

disposing first drain tubes into the zone of ground to be dried, for collecting in said first drain tubes at least a part of the liquid to be evacuated for drying the zone, substantially horizontally disposing second drain tubes above said zone of ground, disposing the second drain tubes within an embankment permeous to water, the embankment being disposed on the zone of ground to be dried and being in fluid communication with the first drain tubes, recovering the zone of ground to be dried and the embankment by a substantially air-tight membrane, creating a peripheral sealing at a periphery of said membrane for allowing an air depression to be obtained under the membrane, said membrane being crossed over by the second drain tubes, disposing ducts under the membrane, at a level above the level of the second drain tubes, having the membrane crossed over by said tubes and connecting the tubes to a fluid suction means, for creating an air depression under the membrane, having said second drain tubes communicated with a suction pump and with the liquid collected from the first drain tubes, wherein the step of disposing the ducts under the membrane comprises:

connecting, under the membrane, at least some of said ducts to third drain tubes comprising fluid input holes, disposing said third drain tubes substantially horizontally in the embankment, while disposing the third drain tubes in a higher part of the embankment which is unsaturated with liquid, and wherein the step of disposing the second drain tubes in the embankment comprises the step of disposing two successive second drain tubes at a relative distance of about 5 to 25 times higher than the vertical distance between the second drain tubes and the third drain tubes.

12. A method for at least partially drying a zone of ground containing a liquid, the equipment comprising:

disposing first drain tubes into the zone of ground to be dried, for collecting in said first drain tubes at least a part of the liquid to be evacuated for drying the zone, substantially horizontally disposing second drain tubes above said zone of ground, disposing the second drain tubes within an embankment permeous to water, the embankment being disposed on the zone of ground to be dried and being in fluid communication with the first drain tubes, recovering the zone of ground to be dried and the embankment by a substantially air-tight membrane, creating a peripheral sealing at a periphery of said membrane for allowing an air depression to be obtained under the membrane, said membrane being crossed over by the second drain tubes, providing the second drain tubes with fluid input holes, and having said second drain tubes communicated with a suction pump, expelling air and liquid contained in the embankment, through the second drain tubes and said fluid input holes thereof, for creating said air depression under the membrane, while expelling the liquid collected from the ground.

* * * * *